US005484302A

United States Patent [19]

Yamada et al.

[11] Patent Number: 5,484,302

[45] Date of Patent: Jan. 16, 1996

[54] LATCHING DEVICE AND A CARD EDGE CONNECTOR WITH SUCH A LATCHING DEVICE

[75] Inventors: Tomoo Yamada, Yokohama; Yoshitsugu Fujiura, Tokyo, both of Japan

[73] Assignee: The Whitaker Corporation, Wilmington, Del.

[21] Appl. No.: 210,801

[22] Filed: Mar. 18, 1994

[30] Foreign Application Priority Data

May 31, 1993 [JP] Japan ..... 5-034102 U

[51] Int. Cl.[6] ..... H01R 4/38

[52] U.S. Cl. ..... 439/326; 439/328

[58] Field of Search ..... 439/325, 326, 439/327, 372, 629, 630–637, 64, 62, 350, 352, 357, 358, 328

[56] References Cited

U.S. PATENT DOCUMENTS 4,995,825 2/1991 Korsunsky et al. ..... 439/328

5,100,337 3/1992 Lee Chao ..... 439/326

5,174,779 12/1992 Chung ..... 439/328

5,234,354 8/1993 Smart ..... 439/328

*Primary Examiner*—Gary F. Paumen

*Assistant Examiner*—Hien D. Vu

*Attorney, Agent, or Firm*—Timothy J. Aberle; Adrian J. LaRue

[57] ABSTRACT

A latching device (10) for a card edge connector (30) and auxiliary board (60) having a first arm (12) and a second arm (14), wherein the second arm includes a latching unit (20) and a latching release unit (26), when the latching device (10) is inserted into a receptacle compartment (46) in the connector (30), the first arm (12) is biased toward the second arm for fixing the latching device (10) in the receptacle compartment. The latching unit (20) includes round shoulders (22, 24) which are provided to fit into round recesses (62) of an auxiliary board (60). A directed pressure (A, B, C) placed on the release unit (26) causes the latching unit (20) to rotate away from an area in card edge connector (30) where an auxiliary board is disposed.

15 Claims, 3 Drawing Sheets

LATCHING DEVICE AND A CARD EDGE CONNECTOR WITH SUCH A LATCHING DEVICE

This invention relates to latching devices and card edge connectors in which such devices are used, and especially relates to the latching devices providing for an easy release of a latched connection of a base board inserted in a card edge connector.

BACKGROUND OF THE INVENTION

Card edge connectors are widely used in personal computers and other electronic equipment for the connection of SIMMs (single in-line memory modules) and other similar electronic components to a mother board. In order to prevent such electronic elements from being disconnected from the base board during operation, these card edge connectors are usually equipped with latching devices. FIG. 8 represents an example of such a latching device (Japanese Patent (1991)-108286). This latching device 100, made in a roughly U-shaped configuration, has two arms: 102 and 104, with the arm 104 being equipped with a latching unit 106 and a latching release unit 108. The axis of this latching device 100 is perpendicular to the mother board (not shown in the drawing) and it is arranged inside the connector housing (not shown in the drawing). The release of the latching between the board with the auxiliary board (not shown in the drawing) and the latching unit 106 is carried out either by directly operating the latch 106 or by pressing the inclined surface of the latch release unit 108 downward either by a tool or by a finger.

The latching device described above is effective when it is used with a card edge connector retaining the auxiliary board in a position approximately perpendicular to the mother board. However, if the auxiliary board is used in connectors which are practically parallel to the mother board for the purposes of compactness, the following problems arise. Since the direction of latch release is approximately parallel to the mother board (or to the auxiliary board), the latching release operation becomes very difficult, especially if the card edge connector is made in a low-profile configuration. In addition, it looks like it is easy to release the latch by pressing the inclined surface of the latching unit 106, but if the pressure is applied directly to the latching unit 106, the latching between the auxiliary board and the latching unit 106 becomes even stronger, and in fact the release can not be easily achieved.

Therefore, the purpose of this invention is to offer a latching device and a card edge connector in which such a latching device is used providing for an easy release of the latching connection.

SUMMARY OF THE INVENTION

The latching device according to this invention is made in a roughly U-shaped configuration having two arms one which has a latching unit and a latching release unit, with the latching unit being located outside the extension line of said arm and the latching release unit being located inside said extension line.

The card edge connector equipped with a latching device according to this invention consists of a latching device made in a roughly U-shaped configuration having two arms one of which is equipped with a latching unit providing for a latching connection with the base board and a latching release unit and a housing having a compartment in which said latching device is located characterized by the fact that the above mentioned latching unit and latching release unit are located respectively outside and inside of the extension line of said one arm and that, at the time of operation of said latching release device, the above mentioned one arm is turned in the direction of squeezing it using the point of contact of said arm and the internal wall of said compartment as the fulcrum, and the latching is released due to this squeezing.

Below, we give detailed explanations concerning preferred embodiments of the latching device and the card edge connector according to this invention with reference to the appended drawings.

BRIEF DESCRIPTION OF THE DRAWINGS

FIG. 1 is a top view, FIG. 2 is a side view and FIG. 3 is a front view.

DETAILED DESCRIPTION OF THE INVENTION

Figure 2:
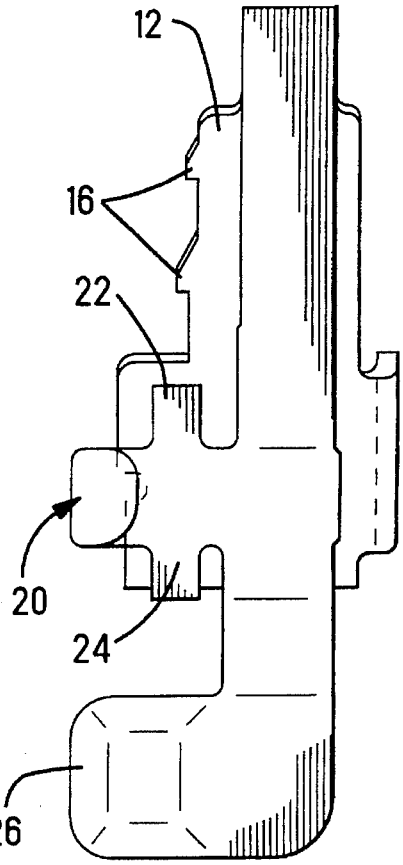
Figure 3:
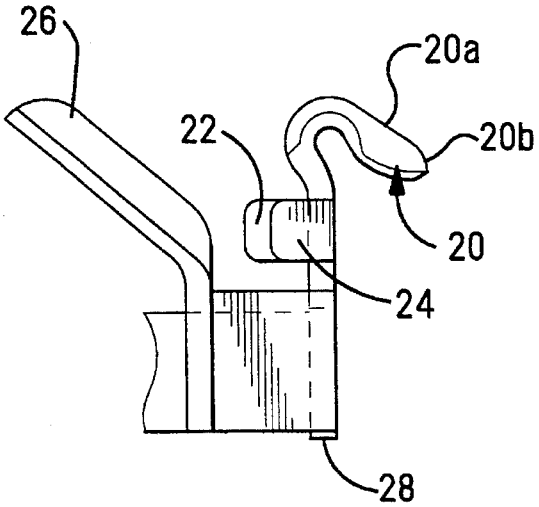
Figure 8:
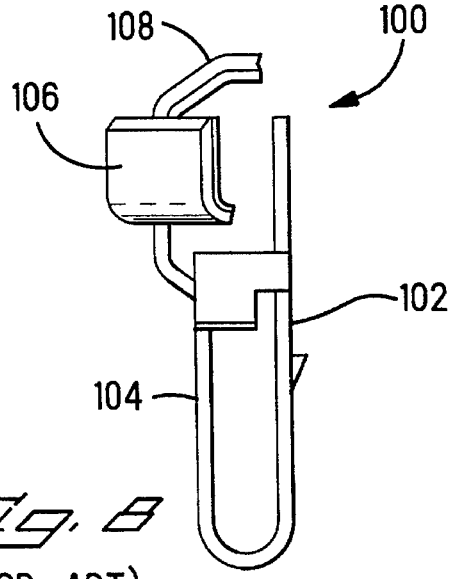
Fig. 8 (PRIOR ART)
FIG. 8 is a conventional latching device.
Figure 5:
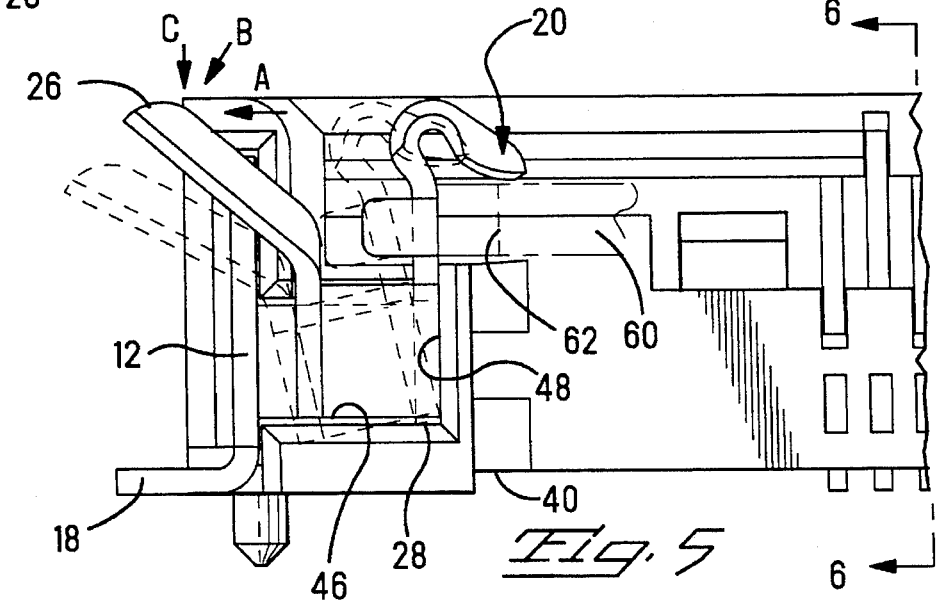
FIG. 5 is a partial top view of the card edge connector having the latching device shown in FIG. 4.

The latching device 10 is made from a sheet of stainless steel or other similar material by stamping and bending to obtain a roughly U-shaped configuration having the first arm 12 and the second arm 14. The first arm 12 has upward facing lugs 16, 16 (FIG. 2) provided for pressing into the receptacle compartment 46 of the connector housing 40. A fixing arm 18 extending outward is provided for the purposes of fixing the connector housing 40 to the mother board (not shown in the drawing) by means of soldering. Approximately in the middle of the second arm 14, a latching unit 20 is made whose purpose is to form a latching connection with the auxiliary board 60 (FIG. 5). This latching unit 20 has a tapered surface **20*a* provided to facilitate the insertion of the auxiliary board 60 and rounded edges 20*b* to minimize potential damage to the auxiliary board at the time of insertion. Between the second arm 14 and the latching unit 20, round shoulders 22, 24 are provided to fit into round recesses 62 of the auxiliary board 60. The radius of curvature of the round shoulders 22, 24 is smaller than that of the round recesses 62, but since both round shoulders 22, 24 fit into the round recesses 62, the fit is tight without play between the round shoulders 22, 24 and the auxiliary board. In the second arm 14, a latching release unit 26 is formed extending inside (toward the first arm 12) with an inclined free end. A curved surface (FIG. 3) is made in the latching release unit 26** to avoid potential injury to the workers.

Figure 1:
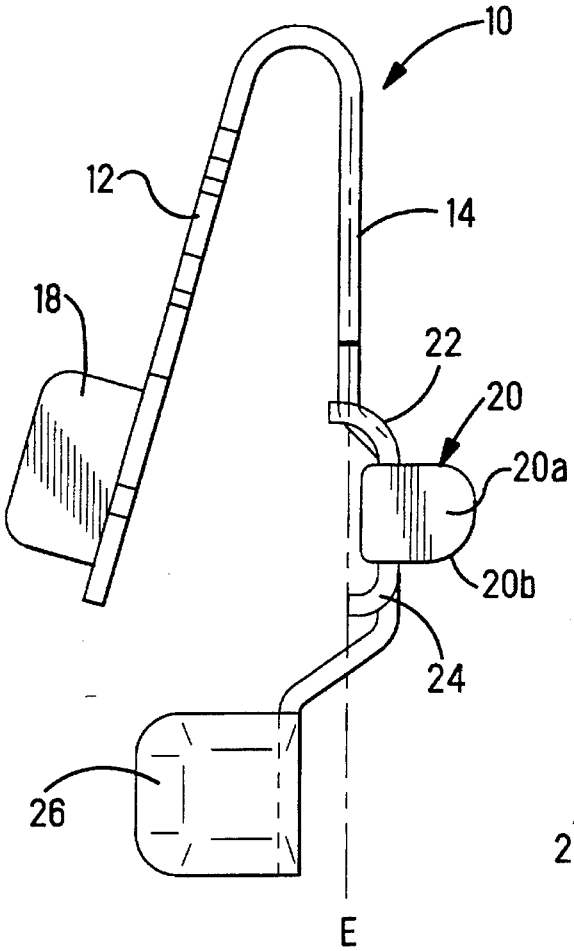
FIGS. 1–3 illustrate an embodiment of the latching device according to this invention.
Figure 4:
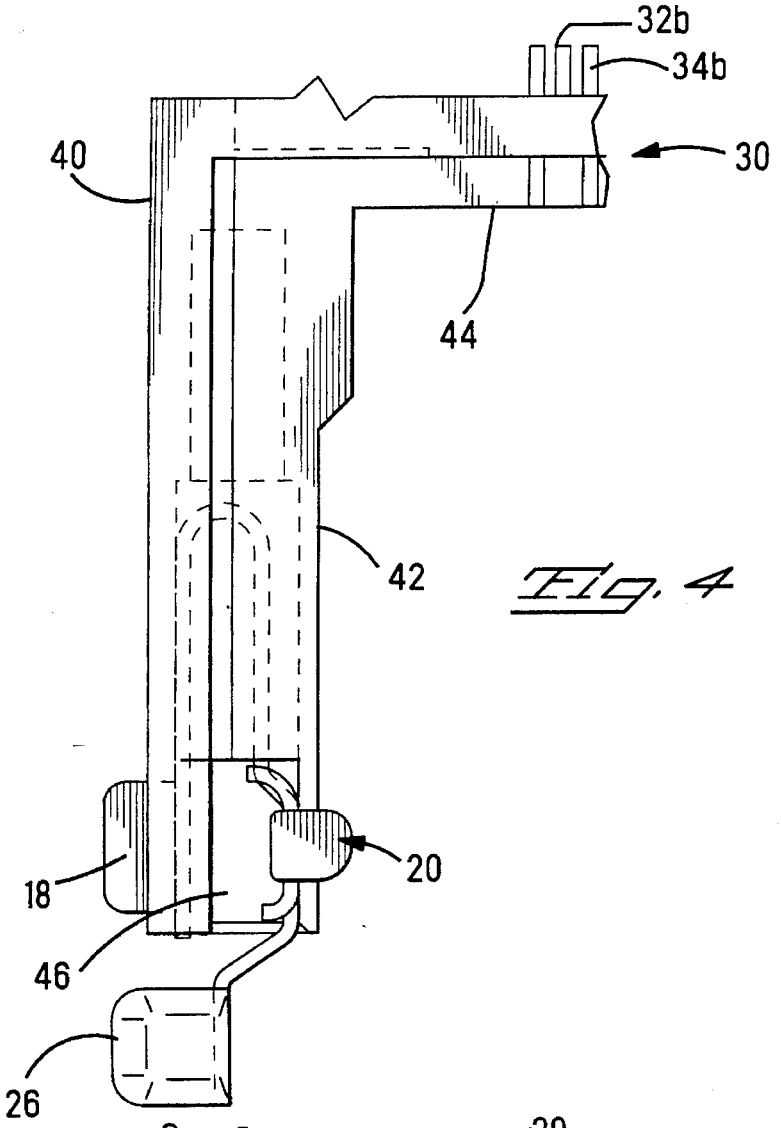
FIG. 4 is a partial top view of a card edge connector having the latching device shown in FIG. 1.
Figure 6:
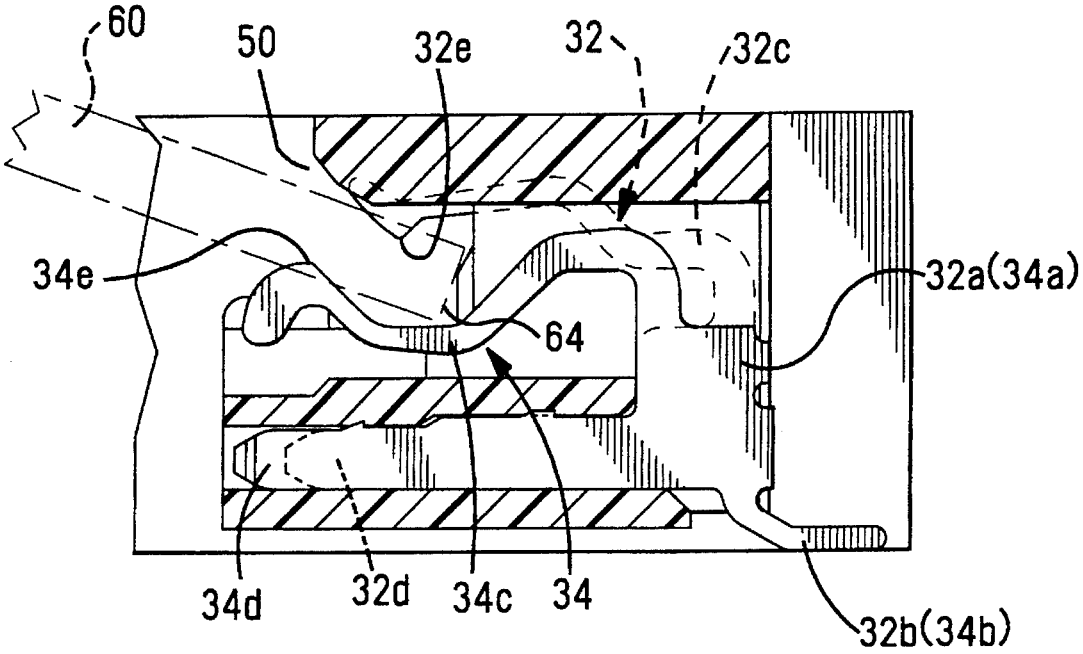
FIG. 6 is a cross-sectional view along the line 6—6 in FIG. 5.
Figure 7:
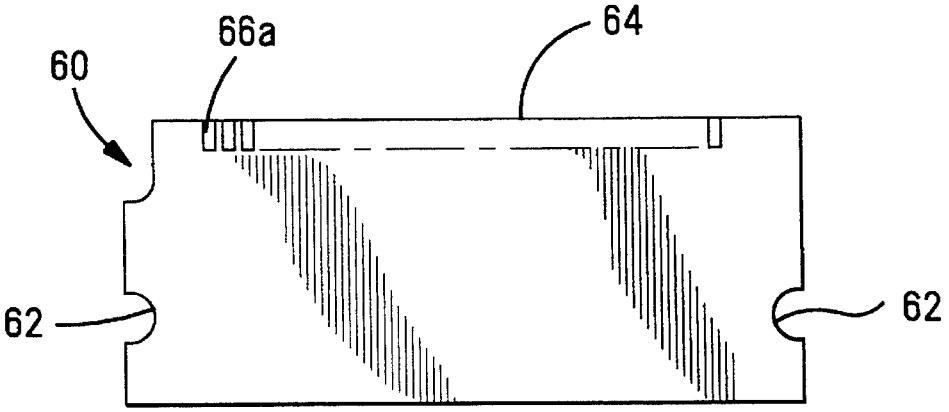
FIG. 7 is a top view of the auxiliary board which can be inserted in the card edge connector shown in FIG. 4.

FIG. 4 is a partial top view of a card edge connector in which the latching device shown in FIG. 1 is used. FIG. 5 is an enlarged view of a portion of the connector shown in FIG. 4. FIG. 6 is a cross-sectional view along the 6—6 line shown in FIG. 5. FIG. 7 is a top view of an auxiliary board which can be inserted in the card edge connector shown in FIG. 4. The card edge connector 30 consists of a housing 40 made in the shape of an open rectangle comprising guide frames 42, 42 located at the left and right sides (only the left frame is shown in the drawing) and the contact containing area 44 connecting the guide frames 42, 42, contacts 32, 34 (FIG. 6) of two types located in the contact containing area 44, and the latching device 10 located in the receptacle compartment of both guide frames 42.

In a unloaded state as depicted in FIG. 1, the first arm 12 and the second arm 14 of the latching device 10 are not parallel to each other, but if the receptacle compartment is filled, the first arm 12 and the second arm 14 become parallel because the second arm 14 comes into contact with the extension wall 48 of the receptacle compartment 46. In this state, the latching device is in a pre-loaded condition. Therefore, when an auxiliary board 60 is connected to the connector 30, the round shoulders 22, 24 fit tightly in the round recesses 62 of the auxiliary board 60, thus eliminating wobbling.

When the front edge 64 of the auxiliary board 60 is inserted into the opening 50 of the contact containing area 44 and when the board 60 is rotated to the position parallel to the mother board, the round recesses 62 and the tapered surface 20*a* of the latching unit 20 become engaged. If the second arm 14 is farther bent to the left (as shown in FIG. 5) against elastic resistance of the latching device 10, the round recesses 62 clear the latching unit 20, thus providing for the auxiliary board 60 being latched with the latching unit 20.

In order to release the latching of the auxiliary board 60, the latching release unit 26 is usually pressed in the direction A as shown in FIG. 5, thus moving the latching unit 20 from the latched position to the unlatched position. However, in the device according to this invention, the release of latching can be achieved by pressing the latching release unit 26 in any direction from B to C. As shown in FIG. 1, the latching unit 20 is located outside (to the right) of the extension line E of the second arm 14, and the latching release unit 26 is located inside (to the left). Therefore, the second arm 14 is rotated counterclockwise (as seen in FIG. 5) using the point of contact of the lug 28 of the second arm 14 with the bottom surface of the receptacle compartment 46 of the housing 40 as the fulcrum. If a pressure force having a downward component is applied to the latching release unit 26, the latching release unit 26 and the latching unit 20 move to the positions shown by the dashed lines, and the auxiliary board moves to the position shown by the dotted line. The latching release unit 26 can be displaced even without the portion of the housing supporting the latching release unit.

As can be seen from the FIG. 6, upper contacts 32 and lower contacts 34 are arrayed in a staggered pattern inside the contact receptacle compartment. Both contacts have bases 32*a*, 34*a* and tie-ins 32*b*, 34*b* of the same configuration, and elastic arms 32*c*, 34*c* and retainers 32*d*, 34*d* of a different shape. In addition, the location of contact points 32*e*, 34*e* (which form electrical contact with the conductive pads 66*a*, 66*b* (only pad 66*a* is shown in the drawing) of the auxiliary board 60) is different from left to right as shown in FIG. 6. As a result of such an arrangement, after releasing the latching, the auxiliary board 60 is pressured by the contact points 32*e*, 34*e* arrayed in a staggered pattern, thus lifting the back end of the auxiliary board 60 shown in the drawing by the dashed line. Therefore, the removal of the auxiliary board after releasing the latching can be easily accomplished.

According to this invention, the release of the latching can be accomplished by applying pressure not only in the direction parallel to the auxiliary board, but also in the perpendicular direction. Therefore, the card edge connectors according to this invention are especially effective in applications where the auxiliary board is located parallel to the mother board for the purposes of compactness of the electronic equipment.

We claim:

1. A card edge connector having a latching device and an auxiliary board, said latching device having a first arm and a second arm, wherein the second arm includes a latching unit and a latching release unit, characterized in that:

when the latching device is inserted into a receptacle compartment in the connector, the first arm is biased (resiles) toward the second arm for fixing the latching device in the receptacle compartment, and wherein the latching unit includes arcuate shoulders to fit into arcuate recesses of the auxiliary board.

2. The card edge connector of claim 1, wherein the radius of curvature of the shoulders is smaller than that of the round recesses.

3. The latching device of claim 1, wherein during insertion of the latching device into the receptacle compartment the first and second arms are moved from a nonparallel to a substantially parallel relationship.

4. The latching device of claim 3, wherein the latching device is in a spring-loaded state when inserted into the receptacle compartment.

5. The latching device of claim 1, wherein a directed pressure placed on the release unit causes the latching unit to rotate away from an area in the card edge connector where an auxiliary board would be disposed.

6. The card edge connector of claim 5, wherein the second arm is subjected to a torsionally directed stress when a directed pressure is applied to the release unit with a portion of the housing acting as a fulcrum.

7. A card edge connector having a latching device and an auxiliary board, said latching device having a first arm and a second arm joined by a bent section so that the first arm and the second arm are nonparalled to one another prior to being mounted to a mounting section of the electrical connector, the first arm and the second arm being substantially parallel when mounted in the mounting section of the electrical connector;

a latching section on one of the first arm or the second arm for latching the auxiliary board in the electrical connector; and a latch release section provided on the second arm which when a release force is applied thereto causes the second arm to torsionally move thereby moving the latching section free of the auxiliary board enabling the auxiliary board to be removed from the electrical connector.

8. The card edge connector as claimed in claim 7, wherein the latching section has a tapered surface for engagement by the auxiliary board to move the arm on which the latching section is located toward the other arm so that the auxiliary board can be moved to a latching position.

9. A latching device as claimed in claim 7, wherein the latching section includes generally arcuate shoulders to fit into an arcuate recess in the auxiliary board.

10. The card edge connector as claimed in claim 7, wherein a fixing arm is provided on the first arm for fixing the electrical connector onto a mother board.

11. An electrical connector for mounting on a mother board and for receiving an auxiliary board therein, comprising:

a housing having electrical contacts secured therein, contact sections of the electrical contacts extending into a board-receiving opening in the housing for electrical connection with conductive pads of the auxiliary board being positioned in the board-receiving opening;

a latching device mounted on the housing and having a first arm and a second arm engaging respective sections of the housing whereby the first arm is biased toward the second arm;

a latching section on the second arm for engagement with the auxiliary board for latching the auxiliary board to the housing; and a latch release section on the second arm which causes the second arm to rotate upon a force being applied thereto thereby moving the latching section free of the auxiliary board to enabling the auxiliary board to be removed from the connector.

12. An electrical connector as claimed in claim 11, wherein said latching section includes generally arcuate shoulders to fit into an arcuate recess in the auxiliary board.

13. An electrical connector as claimed in claim 11, wherein the latching section and the latch release section are offset from on another.

14. An electrical connector as claimed in claim 11, wherein the first arm and the second arm are substantially parallel to one another when mounted on said housing.

15. An electrical connector as claimed in claim 11, wherein said housing has a latch-receiving compartment in which said latching device is mounted.

* * * * *